US006253495B1

(12) United States Patent
Weber

(10) Patent No.: US 6,253,495 B1
(45) Date of Patent: Jul. 3, 2001

(54) METAL ROOF PLATE

(76) Inventor: Hugo Weber, Lindenstrasse 8, 86480 Waltenhausen (DE)

( * ) Notice: Subject to any disclaimer, the term of this patent is extended or adjusted under 35 U.S.C. 154(b) by 0 days.

(21) Appl. No.: 09/214,694

(22) PCT Filed: Jul. 9, 1997

(86) PCT No.: PCT/EP97/03610

§ 371 Date: May 3, 1999

§ 102(e) Date: May 3, 1999

(87) PCT Pub. No.: WO98/01637

PCT Pub. Date: Jan. 15, 1998

(30) Foreign Application Priority Data

Jul. 9, 1996 (DE) ..... 296 11 772 U

(51) Int. Cl.[7] ..... E04D 13/00

(52) U.S. Cl. ..... 52/11; 52/15; 52/24; 52/58; 52/84

(58) Field of Search ..... 52/15, 24, 58, 52/84, 11

(56) References Cited

FOREIGN PATENT DOCUMENTS

4413119 * 11/1994 (DE) ..... 52/15

* cited by examiner

*Primary Examiner*—Beth A. Stephan
*Assistant Examiner*—Dennis L. Dorsey
(74) *Attorney, Agent, or Firm*—Oppenheimer Wolff & Donnelly LLP

(57) ABSTRACT

The invention relates to a metal roof plate for cleaning and maintaining the clean state of building roofs, in particular from plant growth of environmental pollution. The object of the invention is to improve the efficiency of said metal roof plate comprising a metal reacting in conjunction with moisture, said plate being produced by punching from material in the shape of a plate, and having textured reaction surface (2) with raised lumps (3) and openings (4). The object is attained in that the openings (4) of the lumps (3) are inclined in the opposite direction to the direction (A) of water discharge.

20 Claims, 1 Drawing Sheet

A
B
1
2
3
4
5
7
8
9

METAL ROOF PLATE

DESCRIPTION

The invention relates to a metal roof plate for cleaning and maintaining the clean state of building roofs, in particular from plant growth or environmental pollution, and consists of a metal reacting in conjunction with moisture, the metal roof plate being produced by punching from material in the shape of a plate and having a textured reaction surface with raised lumps and openings.

A device of this kind to protect house roofs from plant growth, in particular moss and lichen, is known from the applicant's DE 44 13 119 C2. By manufacturing the metal roof plate from material in the shape of a plate using a process of punching, the possibility is created of adapting the metal roof plate in a simple manner to the shape of the roofing tile used when covering the roof. In particular, the bottom chamfer can, during manufacture and at the time of the punching process, be shaped in such a way that, compared to a simple copper plate, a visually attractive shape is produced and that, in particular, the reaction surface can be used to a great extent for the moisture discharging between two rows of roof plates. Moreover, the result is that the metal roof plate is easier to mount, since the outer form of the metal roof plate, marrying with the roofing tile, can be pushed easily between the individual rows of roofing tiles.

Moreover, manufacturing by punching the individual metal roof plate provides the simple facility, unlike an inserted smooth copper plate, of forming a bead on the outer edge all the way round each individual roof plate, which bead delays fast moisture discharge, thus increasing the reaction time between the moisture and the metal roof plate. During the manufacture, by punching, of the metal roof plate, it is possible, in the half of the metal roof plate lying downwards in the direction of water discharge (reaction surface), to emboss raised lumps, so that the discharging moisture has to travel the longest possible route and, at the same time, a good distribution of the moisture on the surface of the roof is ensured. Moreover, at the same time as the punching process and the raised (proud) pressed-out lumps, provision can be made, at their highest points, for slotted openings, via which liquid, even on the underside of the metal roof plate, is able to react with the underside of the metal. The intention here is to achieve a doubling of the reaction surface so that, in contrast to the known system, it is possible to achieve a considerable reduction in the number of the rows to be covered and achieve at the same time a high level of effectiveness. The narrow slotted openings, however, allow only a relatively small amount of moisture to reach the underside of the metal roof plate.

In the case of the DE-A-41 30 365, moreover, in order to protect the roof covering against the growth of moss occurring in the course of the years, copper plates are fitted in the visible area of the roof surface, so that they come into contact with rainwater, and that the draining rainwater flows over the greatest possible area of the roof covering beneath the copper plates. In the process, the rainwater releases elements from the copper plates, in particular ions, which counteract plant growth, in particular moss and lichen, on the concrete or roofing tiles. The copper plates preferably take the form of ridge capping, arranged along the ridge of the roof, so that the draining moisture can discharge over the entire surface of the roof. As an alternative to the arched ridge capping, which is difficult to manufacture, simple strip-like copper plates can be fitted in the area of the roof gable.

However, the drawback here is that, due to the bending operations required in adapting to the ridge capping, the manufacture of the ridge capping version is very time-consuming. The alternative of providing an inserted strip-like copper plate in the area of the roof gable is, indeed, relatively simple to make, in that a copper plate is unwound from the roll, but then there remains between two consecutive rows of roof plates only a small effective area of the copper agent, so that, in order to provide appropriate effectiveness against plant growth over the roof area, it is necessary to insert a great number or such rows of copper strips. This again results in an overall high cost. Moreover, such copper strips, in particular when refurbishing existing roofs, are difficult to attach, since the copper strips have to be inserted and secured between two rows of roof plates, and to achieve this a greater number of roof plates have to be removed, depending on the length of the copper strip used.

It is therefore the object of the present invention to provide a further improvement to the effectiveness and manageability of a metal roof plate for cleaning and maintaining the clean state of the building roofs.

This object is attained by means of a metal roof plate having the features claimed in claim 1.

Because of the inclination of the openings in the lumps away from the direction of the discharging water, i.e. towards the ridge of the roof, improved entry to the underside of the metal roof plate is rendered possible. Because of the improved wetting of the underside of the metal roof plate with the moisture that this produces, it is possible to improve the use made of the underside of the roof plates, so that, as a result, the cleaning effect on the roof of the building is increased. In particular, there remains, as a result, a relatively large amount of residual moisture on the underside of the metal roof plate, thus increasing the release of the metal ions.

Moreover, the effect of the openings in the lumps facing away from an observer standing on the ground and looking at the roof surface, is to give a more even appearance to the metal roof plate. Also, the openings inclined in the direction of the water discharge largely prevent burrs during the stamping process, so that, in this way, the danger of injury is reduced, even without expensive reworking, and handling thus improved.

Further advantageous embodiments are the subject of the sub-claims. Here, there is considerable significance in the pre-oxidation of the metal plate by an ultrasonic cleaning process and/or degreasing with a chemical cleaning agent, e.g. a lye or an acid. This causes the activation of the copper ions on the surface of the metal roof plate, so that the effect of the metal roof plate can be produced as soon as it is laid on the roof of the building. In this process, this pre-oxidation is carried out by removing the rolling grease otherwise present on the copper strip, both on the top and on the underside of the metal roof plate.

Moreover, simultaneously with the punching process, it is possible to emboss, on the top of the metal roof plate, a bead layer, which forms a support for the roofing tile lying above it. The narrow interstice created thereby provides, moreover, a ventilation facility for the brick or concrete roofing tiles on the building roof.

A preferred embodiment will be explained and described in more detail by means of the drawing below, wherein.

Figures 1, 2, 3, 4:
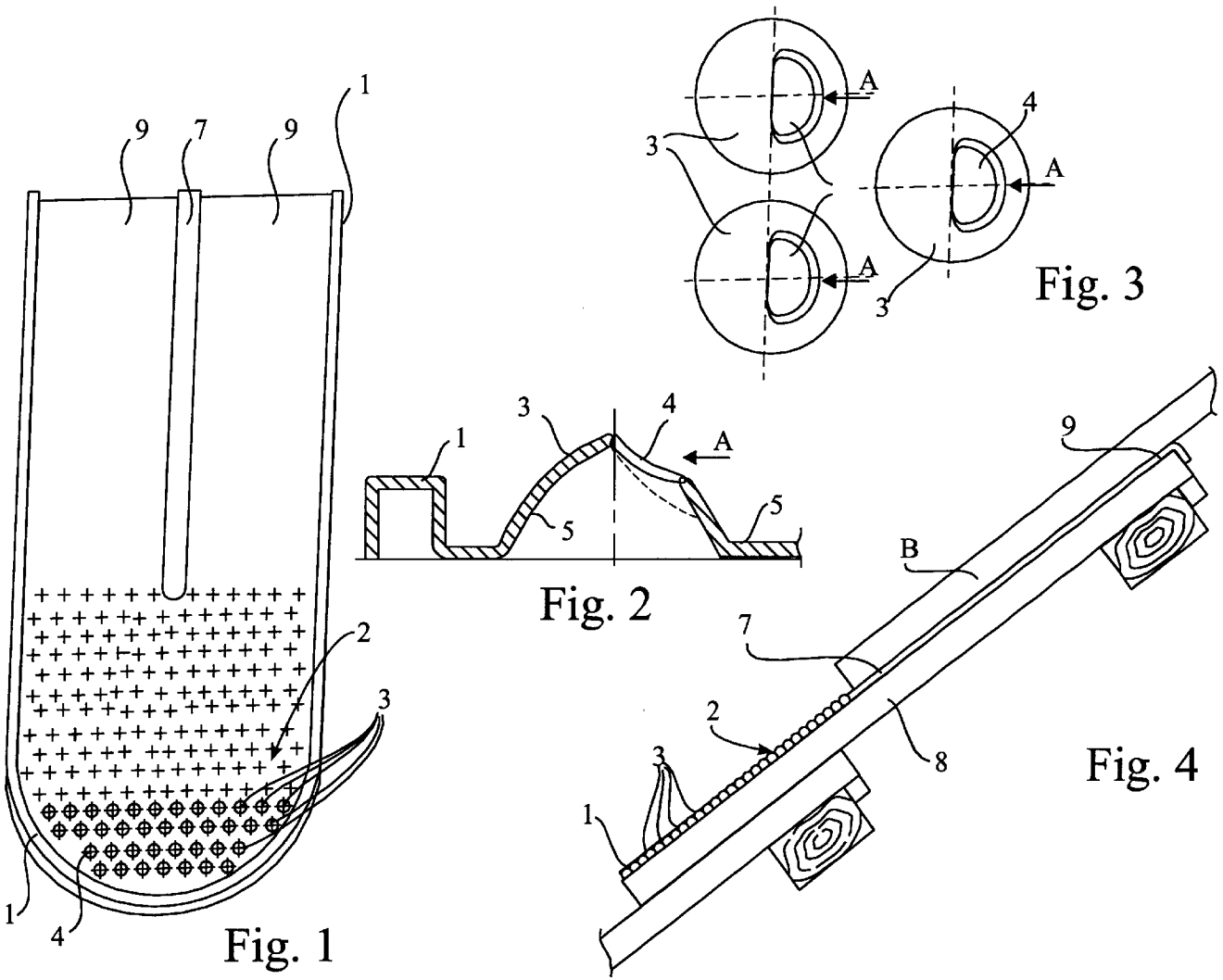
FIG. 1 shows a plan view of a so-called beaver-tailed metal roof plate.
FIG. 2 shows an enlarged cross-sectional illustration through the lowest edge area of the metal plate in FIG. 1.
FIG. 3 shows an enlarged, cut-out plan view in accordance with FIG. 1.
FIG. 4 shows a longitudinal illustration showing the position for fitting the metal plate between two rows of roof plates (brick or concrete roofing tiles).

FIG. 1 represents, in a plan view, a metal roof plate, which is formed by a surrounding bead 1 (cf. also FIG. 2) in the shape of a so-called beaver-tailed roof plate. This is achieved by punching out the metal roof plate along the surrounding bead area 1 made of material in the shape of a plate, in particular copper plate, with the surrounding bead area 1 at the same time being embossed. Moreover, in the lower half of a reaction surface 2, marked with crosses, which, when the metal roof plate (cf. FIG. 4) is in the inserted condition, points outwards from the roof surface, a large number (in this instance approximately 150 per metal roof plate) of lumps 3, are embossed or pressed out of reaction surface 2.

According to the invention, asymmetrically arranged openings, in particular in the form of elliptical recesses (cf. FIG. 3) are provided, which are offset from the highest points of the lumps 3 pressed out of the reaction surface 2. By texturing reaction surface 2 in this way in the form of proud, pressed-out lumps 3, on the one hand discharge of liquid is impeded, so that the moisture (rainwater or melted snow and the like) has to take the longest possible route between and along lumps 3 and, on the other, a uniform distribution on reaction surface 2 is guaranteed. What this achieves, in particular during gusting and stormy weather, is that the discharging moisture reacts for as long as possible with the metal, thus releasing, from the metal roof plate, copper ions, which prevent the plant growth on the building roofs and have a cleansing effect on the roof surface.

By means of the asymmetric arrangement of openings 4 according to the invention, which are inclined towards direction A of the discharging water, it is achieved that a large part of the discharging moisture can flow from top 6 to underside 5 of the metal roof plate, where it can react with the metal surface of underside 5. This produces a doubling of the reaction surface, since, even when there is mist or gentle rainfall, capillary action causes moisture to remain on underside 5 of the metal roof plate lying on the building roof, and thus the reaction time of moisture and metal roof plate is significantly increased until the moisture discharges further.

FIGS. 2 and 3 give an enlarged representation of the preferred embodiment of lumps 3 pressed out in the direction of top 6, with openings 4 punched during the punching or pressing process. Clearly visible here is the pocket-trap nature of openings 4 positioned asymmetrically in relation to the centre line of lumps 3, said openings enabling water to enter particularly effectively in direction A of the water discharge towards underside 5. Asymmetric opening 4 may even run as far as top 6, as indicated by a dashed line.

FIG. 4 represents the metal roof plate in the working position between two rows of roofing tiles 8, which may also be made of concrete slabs. Here, on the one hand, the arrangement of textured reaction surface 2, located in the bottom half of the metal roof plate, becomes evident, as also does bead 1 running around the outer rim. Of further significance is additional bead support 7, embossed to stand proud, represented in the upper half—i.e. above reaction field 2 represented in FIG. 1 and on which the roofing tiles 8 thereabove are able to be supported. Between both surrounding bead 1 and bead support 7 there is thus formed a flat interstice 9 which produces improved ventilation for the building roofs.

These interstices 9 are only a few millimetres high, so that, in connection with the relatively long length of these ducts, sufficient protection is provided against any moisture driven in by the wind and which are driven along the roof surface by gusts of wind. However, in this process it is desirable for a certain amount of moisture to be blown into interstices, since the top of the metal roof plate, covered by upper roof plate row 8, is thereby used as a reaction surface.

The effect can be further increased by pre-oxidation, in particular by dipping the metal roof plate briefly into lye- or acid-based cleaning agents and by means of ultrasonic cleaning, so that the activation time otherwise present is circumvented, until release of the metal ions becomes effective. Pre-oxidation can also be accelerated by applying a flame to reaction surface 2 and also by sand-blasting, which produces an additional fine profiling and with it the enlargement of reaction surface 2 (also on underside 5). The proposed metal roof plate can be used to clean or keep clean skylights or similar elements on the roof surface—e.g. also for solar panels on the surface of the roof.

What is claimed is:

1. Metal roof plate, said plate comprising a metal reactive with moisture, said plate being produced by punching from material in the shape of a plate, having an outer rim and having a textured reaction surface with raised lumps having tips and openings, characterized in that the openings of the lumps are inclined away from a direction of water discharge.

2. Metal roof plate as claimed in claim 1, characterised in that the metal roof plate comprises a material containing copper.

3. Metal roof plate as claimed in claim 1, characterized in that the outer rim of the metal roof plate is formed by a bead which impedes moisture discharge.

4. Metal roof plate as claimed in claim 1, characterized in that the lumps with the openings are arranged together in close formation in the form of a grid in the reaction surface of the metal roof plate.

5. Metal roof plate as claimed in claim 1, characterized in that the lumps are placed in an offset arrangement relative to each other in the water discharge direction.

6. Metal roof plate as claimed in claim 1, characterized in that the openings are arranged laterally from the tips of the lumps punched out of the reaction surface and oriented in a direction towards a roof ridge.

7. Metal roof plate as claimed in claim 1, characterized in that the openings are formed in the shape of an ellipse.

8. Metal roof plate as claimed in claim 1, characterized in that on an upper side of the plate is arranged a support bead for an overlying roof plate to form a ventilation interstice.

9. Metal roof plate as claimed in claim 1, characterized in that at least one of an upper side and an underside of the metal roof plate has been pre-oxidized.

10. Metal roof plate as claimed in claim 9, characterized in that said at least one side of said plate has been pre-oxidized by at least one of ultrasonic cleaning and degreasing using at least one of a chemical cleaning agent and sand-blasting a flame treatment.

11. A metal roof plate as recited in claim 2 characterized in that the outer rim of the metal plate is formed by a bead which impedes moisture discharge.

12. A metal roof plate as recited in claim 2 characterized in that the lumps with the openings are arranged together in close formation in the form of a grid in the reaction surface of the metal roof plate.

13. A metal roof plate as recited in claim 3 characterized in that the lumps with the openings are arranged together in close formation in the form of a grid in the reaction surface of the metal roof plate.

14. A metal roof plate as recited in claim 2 characterized in that the lumps are placed in an offset arrangement relative to each other in the water discharge direction.

15. A metal roof plate as recited in claim 3 characterized in that the lumps are placed in an offset arrangement relative to each other in the water discharge direction.

16. A metal roof plate as recited in claim 4 characterized in that the lumps are placed in an offset arrangement relative to each other in the water discharge direction.

17. Metal roof plate as claimed in claim 2 characterized in that the openings are arranged laterally from the tips of the lumps punched out of the reaction surface and oriented in a direction towards a roof ridge.

18. Metal roof plate as claimed in claim 3 characterized in that the openings are arranged laterally from the tips of the lumps punched out of the reaction surface and oriented in a direction towards a roof ridge.

19. Metal roof plate as claimed in claim 4 characterized in that the openings are arranged laterally from the tips of the lumps punched out of the reaction surface and oriented in a direction towards a roof ridge.

20. Metal roof plate as claimed in claim 5 characterized in that the openings are arranged laterally from the tips of the lumps punched out of the reaction surface and oriented in a direction towards a roof ridge.

* * * * *